United States Patent [19]

Vits

[11] 4,019,731

[45] Apr. 26, 1977

[54] DEVICE FOR PLACEMENT OF RHYTHMICALLY CONVEYED SHEETS ON A STACK

[75] Inventor: Hilmar Vits, Leichlingen, Germany

[73] Assignee: Vits-Maschinenbau GmbH, Langenfeld, Germany

[22] Filed: July 20, 1976

[21] Appl. No.: 707,100

[30] Foreign Application Priority Data

July 23, 1975 Germany ..... 2532880
Apr. 10, 1976 Germany ..... 2615864

[52] U.S. Cl. ..... 271/183; 271/196
[51] Int. Cl.[2] ..... B65H 29/68
[58] Field of Search ..... 271/182, 183, 196, 197, 271/231

[56] References Cited

UNITED STATES PATENTS 3,848,752 11/1974 Branch ..... 271/196 X
3,941,374 3/1976 Vits ..... 271/183

*Primary Examiner*—Richard A. Schacher

[57] ABSTRACT

The invention relates to a device for sheet-by-sheet feeding and placing the sheets on a stack, the sheets being conveyed rhythmically one after another, including a conveyor means and a suction braking means disposed below a conveying plane, for transporting the sheets into an effective range of the suction braking means; the ends of the sheets may be held and transported by a deflecting member which is arranged above the conveying plane.

18 Claims, 7 Drawing Figures

DEVICE FOR PLACEMENT OF RHYTHMICALLY CONVEYED SHEETS ON A STACK

BACKGROUND OF THE INVENTION

Sheets which are conveyed rhythmically one after another with respect to their rear edges are produced, for example, by rotational cutters. Using a known cutter which cooperates with a device for stacking, the sheets pass between high-speed upper and lower conveyor belts after having been cut. A low-speed conveyor belt is arranged in a conveying direction behind the lower high-speed conveyor belt, and the upper side of the low-speed conveyor belt is displaced downwards opposite a joint conveying plane of the high- and low-speed lower and upper conveyor belts. A deflecting member is arranged above the conveying plane in the transitional zone between the high- and low-speed lower conveyor belts. The deflecting member is controlled rhythmically with the on-coming rear edges of the sheets, and thus deflects the rear edges of the sheets downwards from the conveying plane onto the lower slower conveyor belt. The downward deflection is carried out in order to obtain space for the leading edge of the next sheet, which is to be separated from the previous sheet. Control of the compressed air by the deflecting member, however, causes difficulties as it is impossible, especially upon a quick succession of sheets (the sensing elements, the relay control, valve, and the air all need more time than the interval between the sheets allows) to keep the compressed air, which deflects the sheet, away from the leading edge of the next sheet. A clean separation is therefore not possible, at least with sheets which follow each other in quick succession. However, when overlapping occurs, the overlapped sheets which have been deposited on the lower low-speed conveyor belt are further transported to the stacking point. Further separation only takes place to a limited extent on this stretch. This means that the front edge of the sheet collides with a stop of the stack at a considerably high speed, dependent on the speed at which the sheets are fed and the degree of overlapping. In the case of thin sheets having a large format, such a collision may lead to crushing of the sheet, setting up a relationship between the stiffness of the sheet and the kinetic energy of the sheet which is unfavorable. (German Offenlegungsschrift No. 1,245,702).

In a different type of separation device, which does not have pneumatic conveyor and braking means, but operates with rollers which come into contact with the material to be conveyed, a pair of rollers is provided as braking means. One of the rollers has a projection, and the other of the rollers has a recess which rotates in synchronization with the former. Whilst one sheet entering the roller gap is not affected by the other area of the two rollers, the sheet end is affected by the projection and the recess. The sheet can consequently be conveyed without any interference by the pair of rollers only until its end, and is then affected by the projection and the recess. As the speed of rotation of the pair of rollers is less than the speed at which the sheet is conveyed, the sheet is decelerated. As the periphery of the projection and the recess are downwardly displaced opposite the conveying plane, the end of the sheet is also deflected downwards at the same time as the braking occurs, so that the leading edge of the next sheet, which is conveyed at a higher speed than the decelerated sheet, can be dropped on top of the decelerated sheet.

In this known device the end of the sheet is indeed also deflected downwards from its conveyance plane by means of the projection; however, this deflection merely serves for sheet separation; no transfer into the effective area of the braking means occurs. The conveyor means remain fully effective. (German Auslegeschrift No. 2,032,800).

OBJECT OF THE INVENTION

It is an object of the present invention, therefore, to produce a device in which the deflecting member is in the form of a conveyor means, whereby it is possible to ensure without any special sensing and control means that the end of a sheet is brought into the effective range of the braking device, and which provides a safe treatment for sheets having a lower than normal degree of inherent stiffness.

SUMMARY OF THE INVENTION

The above object is attained, according to the invention, by the deflecting member being a suction conveyor roller which has projections on its periphery, and which rotates rhythmically with the ends of the sheets in such a manner that the ends of the sheets are laid on the projections.

Transfer from a conveying to a braking effect on the sheets is accomplished merely by moving the ends of the sheets out of the effective area of the suction conveyor roller into an effective range of the suction braking means by means of projections formed on the rollers, i.e., by mechanical and not pneumatical means. Consequently no special means for controlling the suction air is needed. This type of reversal of the conveying effect to the suction effect is achieved exactly, so that the sheets may be fed sheet-by-sheet (i.e., overlapping each other) by the device in quick succession.

The suction conveyor roller is only perforated in the area outside the projections, so that the end of the sheet deflected downwards from the suction conveyor roller can be removed from the suction conveyor roller as easily as possible.

The rollers of the suction table can be coated on their surfaces with a material having a high friction coefficient, in order to achieve a defined conveyance speed upon decelerating the sheet by means of the suction table. The slippage between the sheet and the rollers is thereby kept at a lower level.

A risk exists especially in the case of thin sheet material for it to be drawn into spaces between the rollers which are formed closely one next to another. This risk exists particularly in relation to the beginning of the sheet. To avoid disadvantageous consequences in spaces formed between closely spaced rollers, filler members, particularly threaded rods disposed loosely thereupon, may be provided. The threaded rods are preferably coated with an anti-adhesive means on their surfaces.

A better solution for preventing the critical points of a sheet (the leading edge and/or gumming area) from being pulled into a space between two adjacent rollers, is for the rollers to have axially spaced raised rings on their periphery, by means of which the adjacent rollers intermesh with each other.

The intervening roller space is decreased on selecting the diameter of the rollers by means of the intermeshing of the rollers of the suction table in such a way that the filler member is no longer necessary to prevent the sheet from being pulled into that space. Due to the filler member not being required, a possible source of malfunction does no longer exist, and the device, according to the invention, is consequently made safer.

So that the suction force of the suction table can be applied as directly as possible, the rings of the rollers are perforated for exposure to at least a part-vacuum.

One embodiment of the invention provides that the roller of the suction table positioned opposite the suction conveyor roller has a substantially larger diameter than the other rollers, in order to directly increase the braking effect after the end of the sheet has been deflected due to the flat curving of this roller. The sheets can then follow one another more closely and form a larger contact surface.

The suction table is preferably exposed to a part-vacuum by a two-section suction box arranged underneath the suction table, so that the part of the suction box in the area of the large roller is exposed to a substantially higher vacuum than the second part of the suction box. This measure also serves to increase the braking effect.

The part-vacuum in the second part of the suction box can be easily produced by connecting that part of the suction box to the first part of the suction box by means of an opening which is provided with a throttle flap. The part-vacuum in the second part can then be controlled by means of the throttle flap.

BRIEF DESCRIPTION OF THE DRAWING

The invention is explained in further detail as follows by means of a drawing showing preferred embodiments of the invention. Specifically.

DESCRIPTION OF THE PREFERRED EMBODIMENTS

Figure 1:
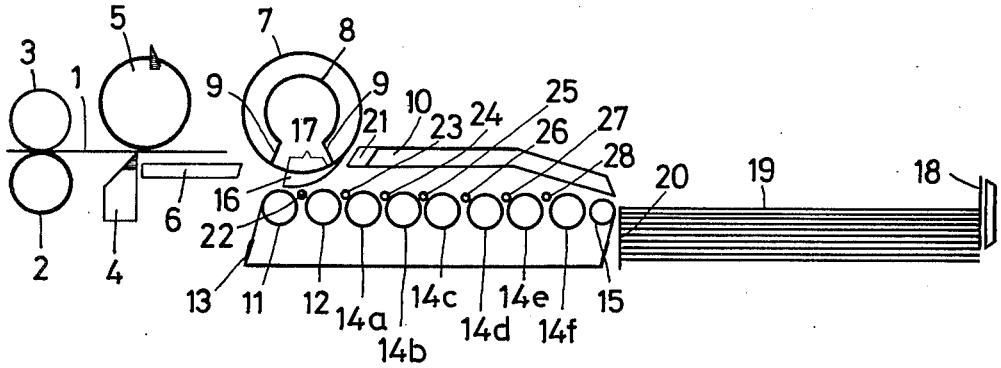
FIG. 1 shows a side view of a device for feeding sheet-by-sheet in schematic form.
Figure 2:
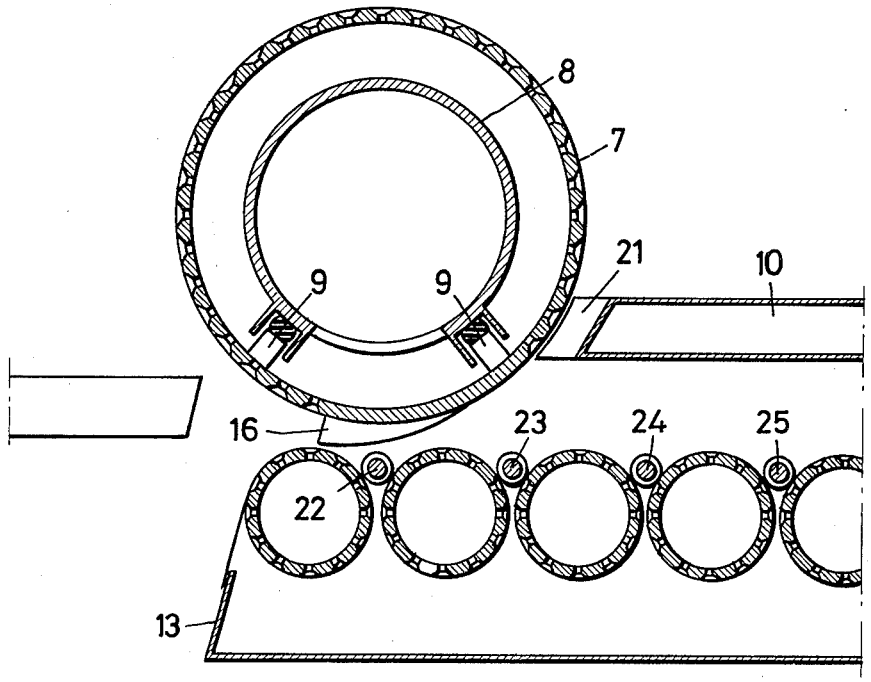
FIG. 2 shows an enlarged section of FIG. 1.
Figure 4:
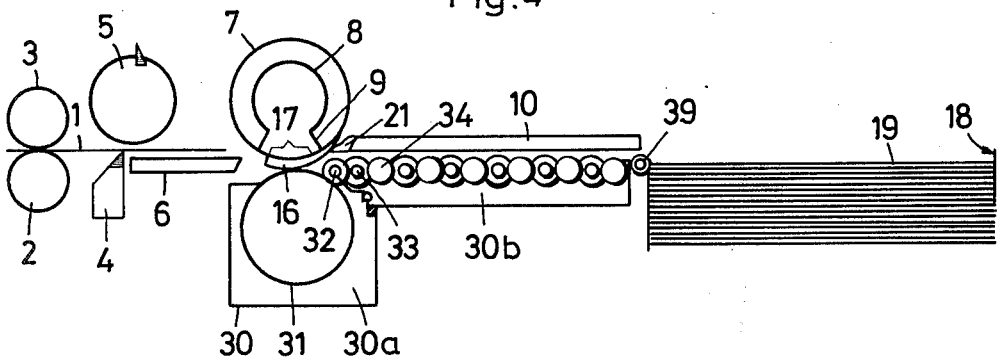
FIG. 4 shows a side view of a modified device for separating sheets in schematic form.
Figure 5:
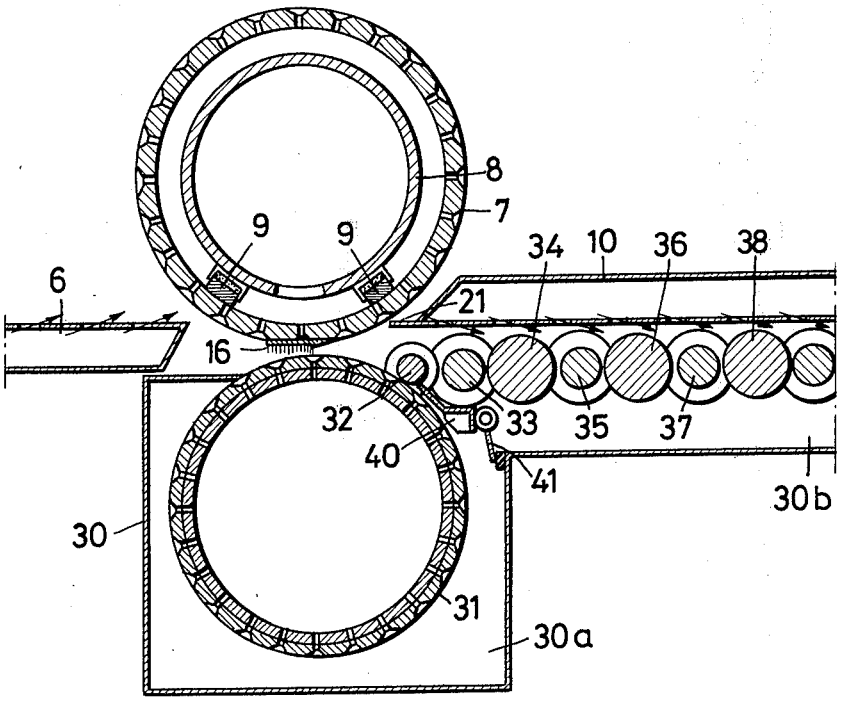
FIG. 5 shows an enlarged section of FIG. 4.
Figure 7:
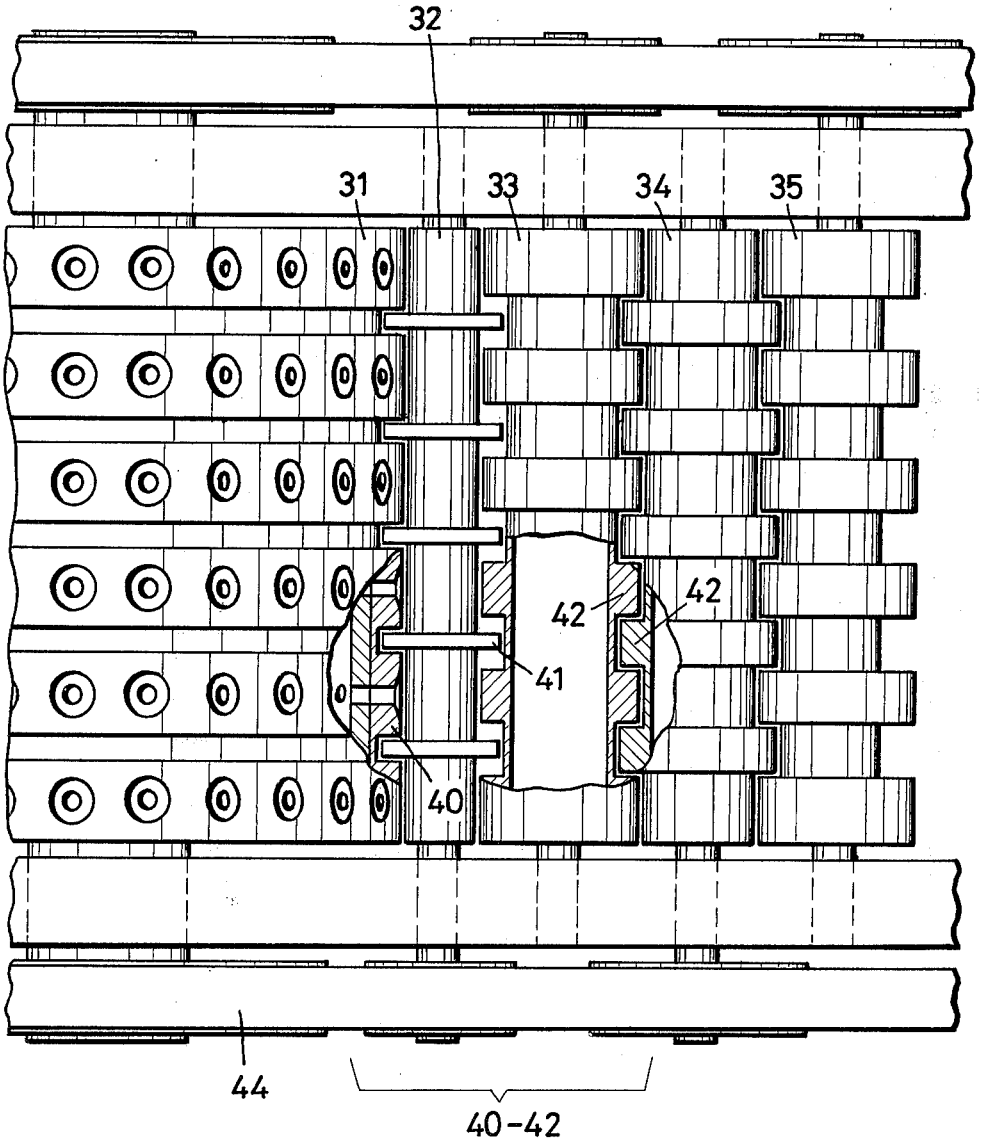
FIG. 7 shows a top view of an enlarged section of FIG. 4.

As comparison of the device of FIGS. 1 and 2 with FIGS. 4, 5 and 7 shows the basic structure of the two devices to be the same. Therefore the construction elements which are the same are also given the same reference numbers.

A roll 1 of paper is conveyed between lower and upper conveyor rollers 2 and 3 to a cutter which is composed of a lower fixed blade 4 and a rotating upper blade 5. The cutting edge of the upper blade 5 has a slightly spiral form so that during rotation and cooperation with the lower blade 4 it cuts the roll 1 into a plurality of sheets.

The cut sheets are conveyed from the cutter 4, 5 to a suction conveyor roller 7 by means of a table 6, which is composed of floating bars operated by compressed air, and is arranged below the conveying plane. The suction conveyor roller 7 is perforated with the exception of an area 17. The suction conveyor roller 7 has crescent-shaped projections 16 in this area 17, best shown in FIG. 5, which extend in a circumferential direction and peak radially at the end on the rear side; the projections 16 are axially spaced from one another. A fixed comb 21 meshes with the spaces between the projections 16. The suction conveyor roller 7 rotates around a suction tube 8 arranged therein so as to be secured against rotation, which suction tube 8 has sealing bars 9 disposed in a lower area on the suction conveyor roller 7, the latter being smooth on the inside. The sealing bars 9 permit the suction effect of the perforated suction conveyor roller 7 to be effective only in the lower area.

A group of floating bars 10 operated by compressed air is arranged in a conveying direction behind the suction conveyor roller 7 and above the conveying plane. A suction table comprising several rollers 11–15 and 31–39 arranged closely next to one another, and a suction box 13, 30 arranged thereunder, is disposed below the conveying plane in the area of the suction conveyor roller 7 and the group of floating bars 10. The rollers 11–15 and 31–38 form an upper cover section of the suction box 13, 30.

In the embodiment of FIGS. 1 and 2 all rollers 11–15 are perforated so that the suction of the suction box 13 can become effective due to the perforation. The rollers 11–14*f* have the same diameter, whereas the roller 15 is somewhat smaller in diameter in comparison to the former. Threaded rods 22–28 are disposed in the space formed between the equal-sized rollers 11–14*f*, the threaded rods 22–28 being disposed loosely on the rollers 11–14*f*. The construction of the rods 22–28 in the form of threaded rods additionally permits suction air to pass through the threads.

In the embodiment of FIGS. 4, 5 and 7 the roller 31, which is disposed first in the conveying direction and below the suction conveyor roller 7, has a substantially larger diameter than the rollers 32–39 positioned behind the roller 31, as seen in the conveying direction. All rollers have axially spaced and raised rings 40, 41 and 42 on their periphery, which are produced by milling out annular grooves in the shell surface of the rollers. The space between the rings 40, 41, 42 and adjacent rollers is formed in such a way in relation to the width of the rings 40, 41 and 42 that adjacent rollers intermesh, as can be seen most clearly in FIG. 7. The shell of the roller 32 is composed of metal, whereas the shells of rollers 31 and 33–39 are composed of hard rubber. The roller 31 operates as a suction roller by means of its perforation and connection to a box 30*a* of high vacuum, whereas the roller 32 and the subsequent rollers 33–39 operate as a suction table by means of gaps existing between the rings and grooves of respective adjacent rollers and their connection to the vacuum-source box 30*b*. Thus perforation of rollers 32–39 is unnecessary. In contrast to the homogeneous suction box 13 provided in the embodiment of FIGS. 4 5 and 7, the suction table is subdivided into a part 30*a* positioned rearwardly in the conveying direction of the sheets, and a part 30*b* positioned forwardly thereof. A cover plate 40 is also provided which is disposed parallel to the rollers 31–39, one end of the plate meshing in the manner of a comb into the shell surface of the roller 32. A throttle flap 41 is connected to the plate 40. An opening formed in part 30*a* of the suction box, which is exposed to high vacuum, and communicating with part 30*b* of the suction box can be adjusted in size by a throttle flap 41. A particularly strong braking effect can be exerted on the sheet with this device at a location where the roller table is least curved.

All the rollers 11–15 and 31–39 have a defined rotational speed which is produced and determined by a belt drive 44 which is only portrayed in FIG. 7 for the embodiment of FIGS. 4, 5 and 7. The rotational speed of the first roller 11, 31 in the conveying direction is substantially lower than the rotational speed of the suction conveyor roller 7. The rotational speed of the next roller 12, 32 is, in contrast, equal to that of the first roller 11, 31. The rotational speed of the subsequent rollers **14*a*–15, and 33** to the last roller which is acted on by suction air, decreases gradually in the conveying direction.

So that the two first rollers 11, 12, 31, 32 can effectively decelerate the sheets, and so that no relative speed between the sheets and the surface of the roller can occur between the rollers **14*a*–15 and 33–39 conveying sheets at progressively decreasing speeds, the surface of the rollers may be provided with a coating having a high friction coefficient. If threaded rods 32–38 are provided in the respective spaces between the rollers 11–14*f*, the threaded rods 22–28 being rotated by the rollers 14–14*f*** against the conveying direction of the sheets and coated with anti-adhesive means, they do not then disturb the conveying of sheets, and do not erase any print on the sheets which may possibly not yet be dry enough to prevent erasure thereof.

The device according to the invention operates in the following way:

The sheet, which is cut from the roll 1 by the cutter 4, 5, and which is conveyed by the floating-bar table 6 of the suction conveyor roller 7, has the leading edge thereof exposed to the suction conveyor roller 7 effectively in the lower area of the latter. As the suction conveyor roller 7 rotating rhythmically in concert with the rotating blade 5 of cutter 4, 5 has a slightly larger diameter than the periphery of the blade 5, its rotational speed is very slightly greater than that of the rotating blade 5 or the speed of the roll 1 which is conveyed to the cutter 4, 5. Consequently the sheet which is picked up by the suction conveyor roller 7 is slightly accelerated, so that a small space is created between the rear edge of the sheet and the leading edge of the next sheet. The leading edge of the sheet picked up by the suction conveyor roller 7 is transferred to the upper floating edges 10. This transfer is made by means of the comb 21, and is facilitated by the suction air of the suction tube 8 not being effective in the transfer area due to the sealing bar 9. Since the cutter 4, 5 and the suction conveyor roller 7 are time correlated with one another, the end of the sheet reaches the projections 16, the latter having the form of bars or preferably small brushes, which deflect the end of the sheet downwards into the effective area of the suction brake roller 11, 31, the latter rotating at a substantially lower rotational speed. This suction brake roller 11, 31 takes up the end of the sheet, declerates its rotational speed, and by so doing provides room above the end of the sheet for the next leading sheet edge. The suction brake roller 11, 31 decelerates the sheet to a conveying speed of only a fraction of the speed at which the sheet is conveyed to the cutter 4, 5. The conveying speed decreases, for example, by 1/10 so that the next sheet overlaps by 90%, i.e., at a much higher percentage than previously known. If the sheet is only decelerated at the end, and the rest of the area of the sheet, particularly the leading edge, remains under the action of the floating bars 10, which are operating in the conveying direction, this ensures that the sheet is held straight. The particular advantage of the floating bars 10 is due to the fact that a new leading edge of a sheet is pulled in between the bars and the rear portion of the preceding sheet remaining suspended on the bars without being crushed.

Figure 3:
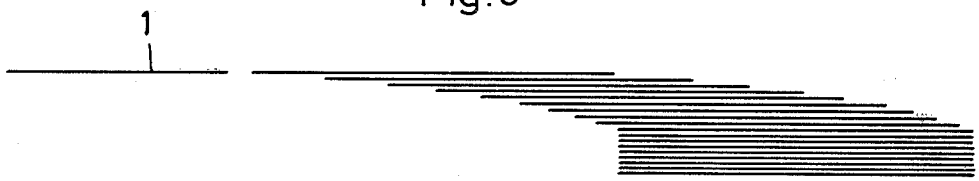
FIG. 3 shows the conveying and separation of the sheets so that the alignment with FIG. 1 is maintained and the height scale is greatly enlarged.
Figure 6:
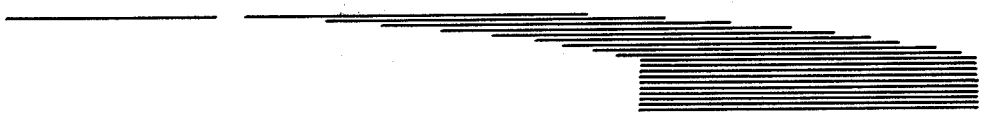
FIG. 6 shows the conveying of overlapping sheets to be stacked so that alignment with FIG. 4 is maintained and the height scale is greatly enlarged.

The overlapping portrayed schematically in FIGS. 3 and 6 occurs as soon as the end of the sheet leaves the suction brake rollers 11, 12, 31 and 32 and reaches the effective area of the suction rollers **14*a*–15 and 33–39, the speed of conveying of the latter being decreased in stages. As a result the sheet being transported reaches such a low speed directly before striking against the stop 8 in the stack 19, that harmful crushing thereof cannot occur. During the whole of the conveying process over the suction table 11–15 and 31–39** it is ensured that the individual sheets are further conveyed at a defined speed, which speed is decreased in stages, so that the rear edges of the sheets are pushed closer and closer together. However, as a consequence of this overlapping effect, the front edges of the sheets also become more closely spaced, so that the remaining free length thereof, when coming to a stop, is so small that harmful bulging, distortion and the like is prevented.

Consequently, the device according to the invention, performs sheet separation and sheet distribution without jamming at high speed, such jam-free separation and distribution being effected and ensured at low cost even when the inherent stiffness of the sheet is low. This is so because the deflecting means, which deflect the rear edges of the sheets ryhthmically downwards into the effective area of the braking means due to the rear edges of the sheet being conveyed, does not disturb the leading edges of the respective next sheets, and the latter can consequently be conveyed with maximum overlapping into the vacated space provided above the previously deflected sheet. The active rear edge conveying of the sheets at progressively lower speeds until the front edge of a sheet practically strikes the stop of the stack ensures that the sheets hit the stop of the stack at a very low speed. Further auxiliary means above the stack, such as conveyor means, are no longer necessary; the stack therefore remains freely accessible from above. This is a requirement which is valued above all by printers.

The sheets, especially the leading edges thereof, their ends and any gumming areas are prevented from being drawn into the space between the individual rollers by the threaded rods provided in that space in the embodiment of FIGS. 1 and 2, and by the intermeshing rollers in the embodiment of FIGS. 4, 5 and 7. In both embodiments a relatively flat conveyor surface is achieved for the sheets even where relatively large roller diameters are employed.

The last roller 15, 39 does not have to exert any braking effect on the sheets as the speed of conveying of the sheets has, at this point already become very low. For this purpose the last roller may be arranged outside the suction box, as shown in the embodiment of FIGS. 4, 5 and 7. The object of that roller, the latter no longer having a braking effect, is then to directly ensure a clean transfer of the sheet before its final position in the stack. A clean transfer can possibly also be achieved by means of a stripping comb which meshes with the grooves of the last rollers. Blowing elements can also be mounted on the device to ventilate the sheets.

While there has been shown what is considered to be the preferred embodiment of the invention, it will be obvious that modifications may be made which come within the scope of the disclosure of the specification. Accordingly,

What is claimed is:

1. A device for placing rhythmically conveyed sheets from a conveying plane individually on a stack one after another, comprising a conveyor means for conveying the sheets, and a suction means for braking the speed of the sheets below the conveying plane, a deflecting member disposed above the conveying plane for passing the ends of the sheets into effective range of said suction means, said deflecting member being a suction conveyor roller having a plurality of projections on its periphery and rotating rhythmically with the ends of the sheets for the sheet ends to be placed on said projections.

2. A device according to claim 1, wherein said suction conveyor roller is perforated only in an area outside said projection.

3. A device according to claim 1, wherein said braking means comprises a suction table extending in the conveying direction behind said deflecting member.

4. A device according to claim 3, wherein said suction table comprises a plurality of rollers disposed closely next to one another.

5. A device according to claim 4, wherein each of said rollers is driven in the sheet conveying direction at gradually decreasing rotational speed.

6. A device according to claim 4, wherein the suction-table rollers comprise first and second rollers driven at the same rotational speed in the sheet conveying direction.

7. A device according to claim 4, wherein said rollers comprise last and next to last rollers driven at the same rotational speed.

8. A device according to claim 7, wherein said last roller has a substantially smaller diameter than the remaining rollers.

9. A device according to one of claims 1, wherein said conveyor means comprise a plurality of floating bars operated by compressed air disposed and driven behind said deflecting member as seen in the sheet conveyance direction above said conveying plane.

10. A device according to claim 1, further comprising a cutter arranged in front of said deflecting member and driven in synchronization therewith.

11. A device according to claim 4, further comprising a material having a high coefficient of friction for coating said rollers of said suction table therewith.

12. A device according to claim 4, wherein respective spaces are formed between said rollers, and further comprising a plurality of loosely lying and threaded rods arranged in said spaces, respectively.

13. A device according to claim 12, further comprising an anti-adhesive material for coating said threaded rods on the surfaces thereof.

14. A device according to claim 6, wherein the suction-table rollers have axially spaced raised rings on their peripheries, respectively, for respective adjacent rollers to intermesh with each other.

15. A device according to claim 6, wherein said first roller is disposed opposite said suction conveyor rollers and has a substantially larger diameter than the remaining of the suction-table rollers.

16. A device according to claim 14, wherein the raised rings of at least said first roller are perforated for communicating with at least a part vacuum.

17. A device according to claim 6, wherein said suction table comprises two suction boxes exposed to at least a part vacuum, one of said suction boxes being positioned in the area of said first roller, and being exposed to a substantially greater vacuum than the other of said suction boxes.

18. A device according to claim 17, wherein said suction table is formed with an opening connecting said suction boxes, and further comprising a throttle flap disposed within said opening.

* * * * *